US006715569B1

(12) United States Patent
Rogers

(10) Patent No.: US 6,715,569 B1
(45) Date of Patent: Apr. 6, 2004

(54) BOOM TYPE POWER TONG POSITIONER

(76) Inventor: Tommie L. Rogers, 702 Crestlawn Dr., Lafayette, LA (US) 70503

( * ) Notice: Subject to any disclaimer, the term of this patent is extended or adjusted under 35 U.S.C. 154(b) by 13 days.

(21) Appl. No.: 10/103,056

(22) Filed: Mar. 20, 2002

Related U.S. Application Data

(60) Provisional application No. 60/322,348, filed on Sep. 13, 2001.

(51) Int. Cl.[7] ..... E21B 19/16

(52) U.S. Cl. ..... 175/85; 166/379; 166/77.51

(58) Field of Search ..... 166/77.51, 379; 175/85; 81/57.15, 57.33; 73/862.25

(56) References Cited

U.S. PATENT DOCUMENTS 2,692,059 A * 10/1954 Bolling, Jr. ..... 414/22.51
3,780,815 A * 12/1973 Barron et al. ..... 173/195
3,840,128 A * 10/1974 Swoboda et al. ..... 414/728
3,881,375 A * 5/1975 Kelly ..... 81/57.35
4,077,525 A * 3/1978 Callegari et al. ..... 414/22.63
4,089,427 A * 5/1978 Pardo et al. ..... 414/680
4,274,778 A * 6/1981 Putnam et al. ..... 414/22.71
6,142,040 A * 11/2000 Bouligny ..... 81/57.34
6,212,976 B1 * 4/2001 Stogner ..... 81/57.34

* cited by examiner

*Primary Examiner*—David Bagnell
*Assistant Examiner*—Daniel P Stephenson
(74) *Attorney, Agent, or Firm*—Jesse D. Lambert

(57) ABSTRACT

Apparatus for positioning a power tong at a desired location with respect to the distance above the rig floor, and with respect to the center of the rig floor. A pedestal is secured to the structure of the rig. An upright member is mounted on the upper end of the pedestal, with a bearing disposed between the upright member and the pedestal, the bearing permitting the upright member to rotate around a vertical axis when moved by a powered ring gear assembly. A telescoping boom is rotatably mounted on the upright member, and one end thereof extends over the central part of the rig floor. Power tongs attached to the boom may thereby be positioned at desired positions with respect to the rig floor. Controls mounted on the power tongs and/or on the upright member permit control of the rotation of the boom, the upright member, and the power tong.

19 Claims, 4 Drawing Sheets

BOOM TYPE POWER TONG POSITIONER

STATEMENT OF RELATED APPLICATIONS

Applicant claims priority to provisional patent application Ser. No. 60/322,348, filed Sep. 13, 2001.

BACKGROUND—FIELD OF ART

This invention relates to apparatus used in rig operations associated with the drilling, completion and servicing of oil and gas wells. With more particularity, this invention relates to an apparatus mounted on a drilling or workover rig, in particular on or near the floor of the rig, for positioning equipment in relation to the rig floor. The apparatus is especially suited for, but not limited to, positioning power tongs used to make up and break out threaded connections joining lengths of tubulars.

BACKGROUND—RELATED ART

Positioning equipment above and around the floor of a drilling, workover or completion rig, to permit efficient and safe use, poses certain problems. One type of equipment which requires positioning at different heights above the rig floor, and at different positions with respect to the center of the rig floor, is power tongs. Power tongs are used to screw together ("makeup") and unscrew ("break out") threaded connections which join lengths of tubulars, such as drill pipe. Power tongs, in general, are usually hydraulically powered rotary tongs capable of exerting great torque to make up and break out connections.

In addition, another type of power equipment used in connection with threaded tubulars is commonly referred to as "break out" tools, which are generally adapted to rather limited degree of rotation per "bite" on the threaded connection. While often having great torque capacity, the limited degree of rotation makes these tools generally unsuitable for spinning up and unspinning threaded connections, which task is usually accomplished by other tools.

For purposes of this application, the term "power tong" encompasses both those power tools commonly referred to as power tongs, and also those tools commonly referred to as breakout tools, and encompasses such tools whether powered by hydraulics, pneumatics, electric motors, or some combination thereof.

Using as an example the makeup and breakout of drill pipe connections, the threaded connections themselves referred to as "tool joints," some connections may be made up with the drill pipe in the slips of the rotary, therefore in one directional sense the connection is in the center of the rig floor. However, the height above the rig floor of the tool joint which must be gripped may vary from connection to connection. Therefore, even when the connection is in the center of the rig floor, it is necessary to be able to position power tongs at a desired height or elevation, which may vary from connection to connection. Other situations entail makeup and breakout of connections spaced away from the center of the rig floor, for example in the "mousehole" or "off line hole." It can be readily seen that power tongs may be required to be positioned in a number of locations above and around the rig floor.

Traditionally, power tongs were hung from a cable fixed to the derrick or mast of the rig. A spring is connected to the lower end of the cable, then to a powered hydraulic lift cylinder, which then connects to the power tong. The hydraulic lift cylinder may be telescoped in and out to raise and lower the power tong to the desired level or height above the rig floor, to grasp the threaded connection. Power tongs may also be suspended from cables attached to airhoists. These traditional means of hanging a power tong permitted elevation adjustments, while to otherwise position the tong it to be pushed or pulled to the desired location (with respect to the center of the rig floor), by one or more rig personnel physically pushing or pulling the power tong (along with raising and lowering via the lift cylinder), as the case may be. Injuries have occurred as a result of the heavy tongs swinging on their cables and striking personnel.

Further problems arise in the positioning of power tongs on floating drilling vessels, such as semi-submersible drilling rigs and drill ships. Such rigs, depending upon weather and sea conditions, may have significant movement of the entire rig, tending to swing the power tongs back and forth. In addition to posing increased difficulty in positioning the power tongs in a desired elevation and location, it will be appreciated that personnel safety concerns are greatly increased, with a heavy piece of equipment swinging on a cable.

In addition to power tongs, other equipment and even personnel must be positioned above and around rig floors. Equipment and personnel are sometimes lifted on air hoist lines, with the attendant problems as described above for power tongs.

It is desirable, then, to have an apparatus, in the nature of a boom type positioner, adapted to be mounted in operable relationship to the floor of a drilling, completion or workover rig, which permits positive placement of equipment and personnel, and holding same in the desired position with respect to the center of the rig floor and an elevation above the rig floor. At the same time, the apparatus is mounted in a location and capable of being placed in a position that rig operations are not impeded when the positioner is not in use.

SUMMARY OF THE INVENTION

The invention comprises a rig mounted, power tong positioner, comprising a telescoping boom rotatably mounted on an upright member, which is in turn mounted on a pedestal mounted on the rig structure, preferably the rig substructure. The apparatus is adapted for use within the structure of the rig mast or derrick, and is adapted to position a rotary power tong at a desired position with respect to the center of the rig floor and elevation about the rig floor, including but not limited to positions above the rotary (or center) of the rig, the mousehole, or off line hole. The telescoping boom of the present invention provides lengthwise adjustment. A first end of the boom is rotatably mounted via a hinge on the upright member, and a second end of the boom (the end opposite the upright member) may thereby be raised and lowered (thereby moving in a plane substantially perpendicular to the rig floor) as the boom is rotated about its pivot point. The second end may be moved in a plane substantially parallel to the rig floor by rotation of the upright member. One embodiment of the invention further comprises a power tong mounted on the second end of the boom. Controls to position the boom, and hence the tong, are mounted on the power tong, in close proximity to the power tong controls, where the power tong operator can readily manipulate both sets of controls. Additional controls are mounted on or near the upright member to permit operation of the positioner and thus placement of the power tongs. Still further controls to operate the power tong unit itself may be mounted on or near the upright member, thereby permitting remote makeup and breakout of threaded connections. Other types of remote controls may be employed to operate the boom and tongs from still more remote locations, such as by radio frequency.

DESCRIPTION OF THE PRESENTLY PREFERRED EMBODIMENT

While the ensuing description sets forth the present invention in the context of a power tong positioner, it is understood that the invention may be used to position different types of equipment, and personnel, at desired positions above the rig floor. In one presently preferred embodiment, the invention comprises a rig mounted, power tong positioner, comprising a telescoping boom rotatably mounted on an upright member. The upright member is mounted on a bearing and powered ring gear assembly. The bearing is in turn mounted atop a pedestal which is fixed to the rig structure, preferably to the rig substructure, in operable relationship to the rig floor. The positioner is adapted to hold and position a power tong, attached to the boom, at a desired location and height about and above the rig floor, including but not limited to a location above the center of the rig floor or an off-center position, such as over the mousehole or off line hole. Means for rotating the boom about the hinge, and for rotating the upright member, are provided. Controls mounted on the power tong permit control of the tong mechanism as well as the positioner.

While the invention may be used on a drilling rig, a workover or completion rig, or some other classification or size of rig, for the purposes of this description its use on a typical drilling rig will be described. The floor of a drilling rig, depicted in FIG. 1, often referred to as the "rig floor," is that part of the rig at or near the base of the rig, on which is located the rotary 10 (a powered rotating table at or near the center of the rig floor, and positioned over the well borehole, which provides a means of rotating a tubular string positioned therein), and usually other penetrations or "holes" through the rig floor. On some rigs, the powered rotating table may be omitted because rotation of tubulars may be done by some type of other drive unit; in such instances, the center of the rig floor still houses a set of bowl and slips to support tubulars and is positioned as shown for element 10. Two of such additional penetrations are typically a "mousehole" 20 (an opening through the rig floor, relatively close to the rotary, into which joints of drill pipe are placed in order to be screwed to the rotary kelly, picked up and thereafter made up into a drill string) and an "off line hole" 30 (an opening through the rig floor, usually a greater distance from the rotary than the mousehole, into which tubulars may be placed for makeup in, preparation for incorporating into the drillstring). It is understood that for purposes of this patent application, the term rig floor encompasses the structure within the general boundary of the legs of the rig derrick or mast, and adjacent structure at substantially the same elevation as the rotary, which may be outside the boundary of the legs of the rig derrick or mast.

Figure 1:
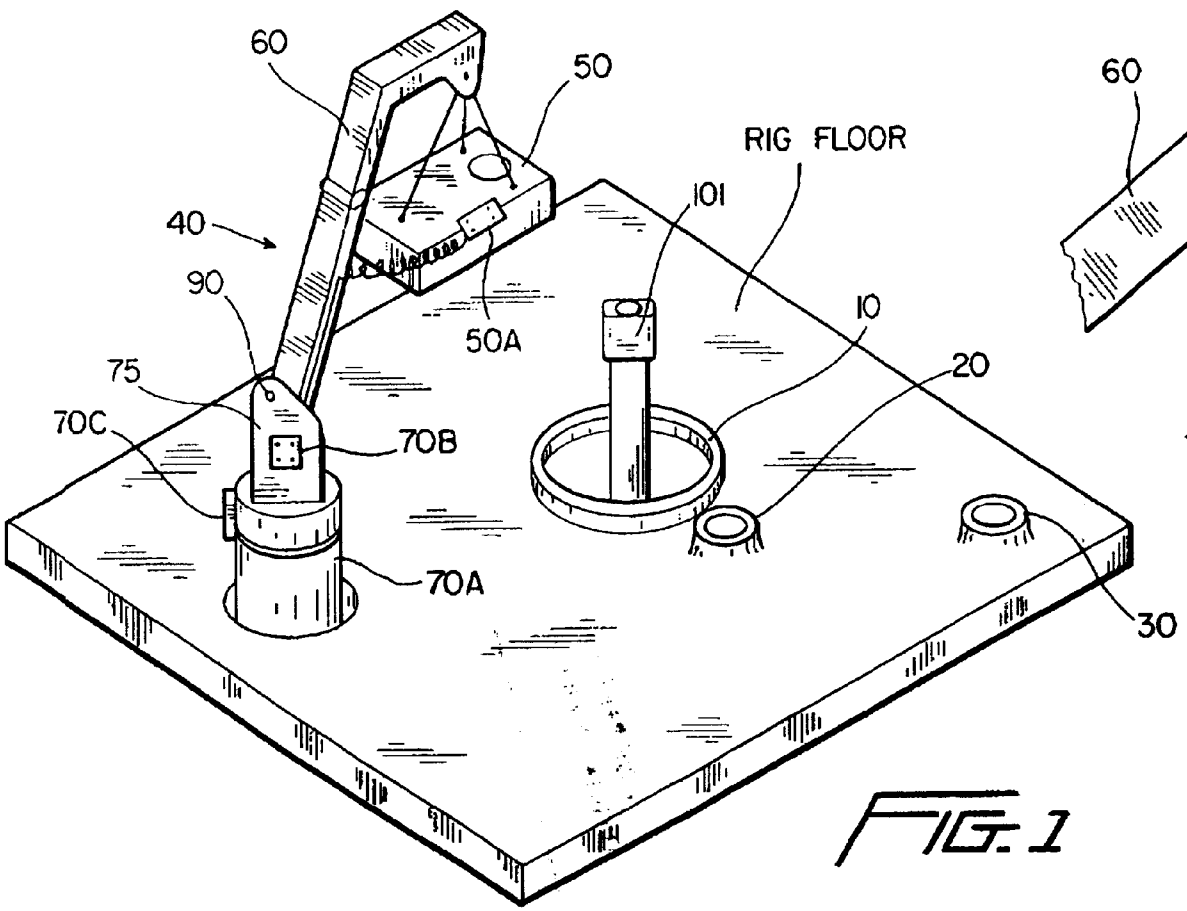
FIG. 1 is a perspective view of the invention showing it mounted in operable relation to the rig floor.
Figure 2:
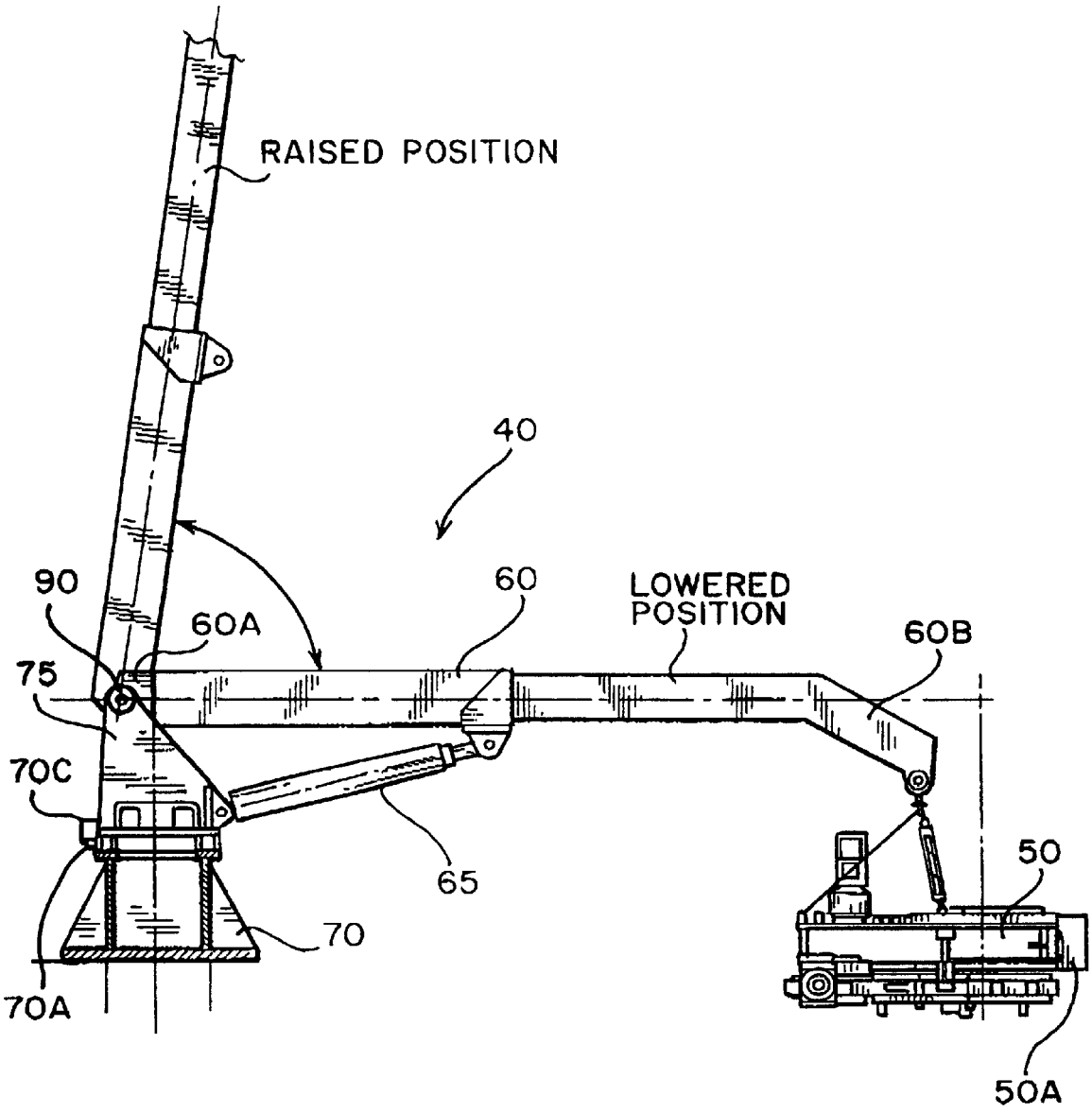
FIG. 2 is a view of the invention in more detail, showing the boom in a lowered position.
Figure 3:
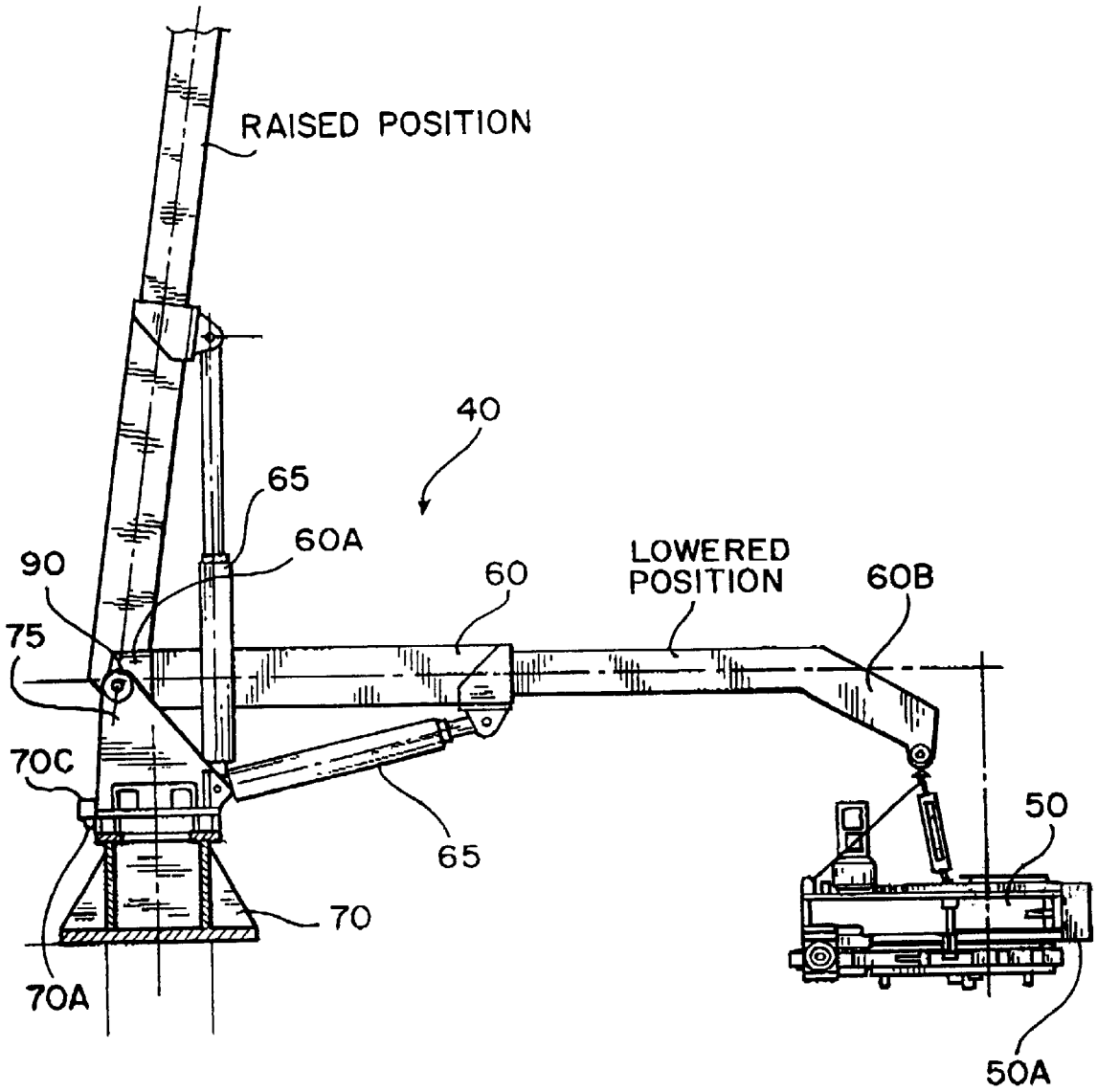
FIG. 3 is a view of the invention showing the boom in a raised position.

Referring to the drawings, especially FIGS. 1–3, one presently preferred embodiment of the invention 40 comprises a pedestal 70 mounted on a rig structure. Pedestal 70 is preferably incorporated into the rig substructure so as to provide a very strong base, and is mounted so that an upper end is in operative relationship to the rig floor. While pedestal 70 may be incorporated into the rig structure when the rig is fabricated, pedestal 70 may also be added to the rig structure post-construction. A means for rotating an upright member 75 (described below) is mounted atop pedestal 70, which in the preferred embodiment comprises a bearing 70A comprising a powered ring gear assembly, which in turn comprises a motor 70C driving a pinion gear on one half of the bearing, engaging a ring gear on the other half of the bearing. Upright member 75 is mounted on bearing 70A, which permits rotation of upright member 75 about a substantially vertical axis. Bearing 70A may be of a configuration well known in the art, comprising balls mounted in a pair of races, or other suitable configurations. Motor 70C drives the pinion and ring gear assembly of bearing 70A, an arrangement well known in the art. Motor 70C is controlled by controls 50A and/or 70B, as will be later described, to control rotation of upright member 75, and hence boom 60.

A telescopic boom 60 having first and second ends is rotatably mounted on upright member 75 via a hinge 90 at its first end 60A, with the second end 60B at the distal end of boom 60. Second end 60B of boom 60 may be raised and lowered by rotation of boom 60 about the hinge point, by a means for rotating boom 60 about hinge 90. In one presently preferred embodiment, the means for rotating boom 60 about hinge 90 is a telescoping hydraulic cylinder 65. Extension or contraction of hydraulic cylinder 65 raises and lowers boom 60, controlled by controls 50A and/or 70B. The geometry of hydraulic cylinder 65, and its connection to boom 60 and pedestal 70, permits lowering of boom 60 to a position below horizontal. Boom 60 is telescopic, and can extend from a fully retracted position to a fully extended position. By a desired combination of rotation of upright member 75, raising or lowering of second end 60B of boom 60 via rotation of boom 60 about the hinge point, and telescoping/retraction of boom 60, second end 60B of boom 60 (and consequently a power tong mounted thereon) may be placed at any desired location around and above the rig floor, including but not limited to positions within the legs of the derrick or mast. While the scope of the invention is not restricted to any particular boom embodiment, whether in materials, dimensions or number of telescoping sections, one presently preferred embodiment uses a two-piece telescoping boom with an inner section about nine feet long, telescoping within an outer section about ten feet long. This combination permits an extended boom length of about seventeen feet. The cross-sectional shape of the boom may be one which is capable of withstanding high side loading. A typical load capacity for the present invention is nominally 10,000 pounds, capable of positioning power tong units of up to 10,000 pounds. In addition, the side load capacity of the boom, in the preferred embodiment, may be on the order of 2800 pounds. The invention may be made in different capacities as required.

Power tong 50 of the present invention may be a hydraulically powered, rotary power tong, having a set of gripping jaws for gripping and turning a threaded tubular connection, as is well known in the art. The tong may be sized and configured so as to make up and break out such connections on drill pipe, tubing, and casing. Power tong 50 may further comprise an "integral" backup, for holding the lower half of a threaded connection during makeup and breakout, or the backup function may be provided by a separate tool. Power tong 50 has controls 50A mounted on the tong, which the operator uses to function the power tong unit. It is understood that the power tong may alternatively be operated by air, electric motors, or any other power source, and the invention is not limited to the positioning of hydraulic power tongs. Controls 50A also permit the tong operator to control movement of the boom, and thus positioning of power tong 50, via control of rotation of boom 60 above its hinge point 90 (to raise and lower power tong 60),.and control of rotation of upright member 75 (to move power tong 50 in a horizontal plane).

Figure 4:
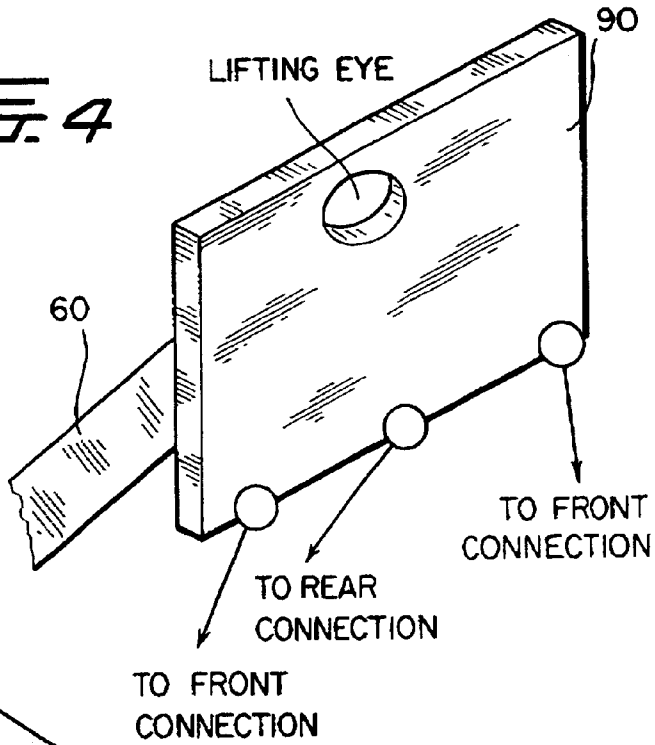
FIG. 4 is a view of one embodiment of connector, for attaching a power tong to the boom.
Figure 5:
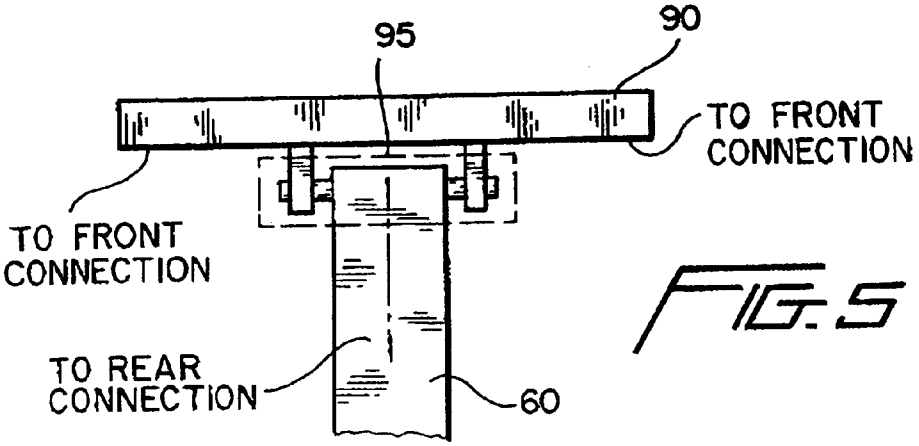
FIG. 5 is another embodiment of connector.

Second end 60B of boom 60 is adapted to connect equipment thereto. In one embodiment, the present invention further comprises a means for connecting power tong 50 to crane boom 60, so that the power tong is fully supported by the crane (i.e., no additional means for suspending the tong, such as conventional cables and the like, are required). One presently preferred embodiment of the means for connecting the power tong to the boom, is shown in FIGS. 4 (perspective view from the front of plate 90) and 5 (plan or top view). Power tong 50 is mounted to a plate 90, typically via three connecting members (two forward connecting members, which attach to two front connection points near the open throat of the tong, and a rear connecting member, attached to a rear connection point at the center of the opposite end or rear of the tong), which may be threaded rods with turnbuckles to permit adjustment of the length of each connecting member, with a short chain section connecting the turnbuckle to the plate. Plate 90 may be fixedly mounted to boom 60, or as seen in FIG. 5 may be mounted to second end 60B of boom 60 via a pin and clevis arrangement 95, which permits the plate to rotate about the longitudinal axis of the pin. Such mounting permits the power tong to remain substantially horizontal despite the angle of inclination of the boom, while minimizing rotation of the power tong about a vertical axis through the power tong rotary assembly.

Figure 6:
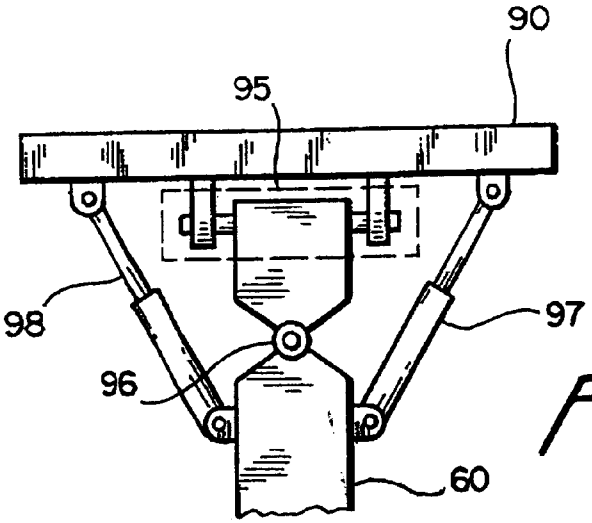
FIG. 6 is yet another embodiment of connector, comprising hydraulic cylinders to assist in positioning.

Yet another embodiment, as shown in FIG. 6 (which is another top or plan view of the means for connecting the power tong to the boom), provides a hinge 96 between plate 90 and boom 60. Rather than a fixed connection (wherein the tong alignment is intended to be kept substantial fixed with respect to the longitudinal axis of the boom), a pair of hydraulic cylinders 97, 98 in combination with hinged connection 96 permit controlled positioning of the axis of the tong body with respect to the axis of boom 60. In this embodiment, controls 50A and 70B further comprise controls for the hydraulic cylinders 97 and 98.

Figure 7:
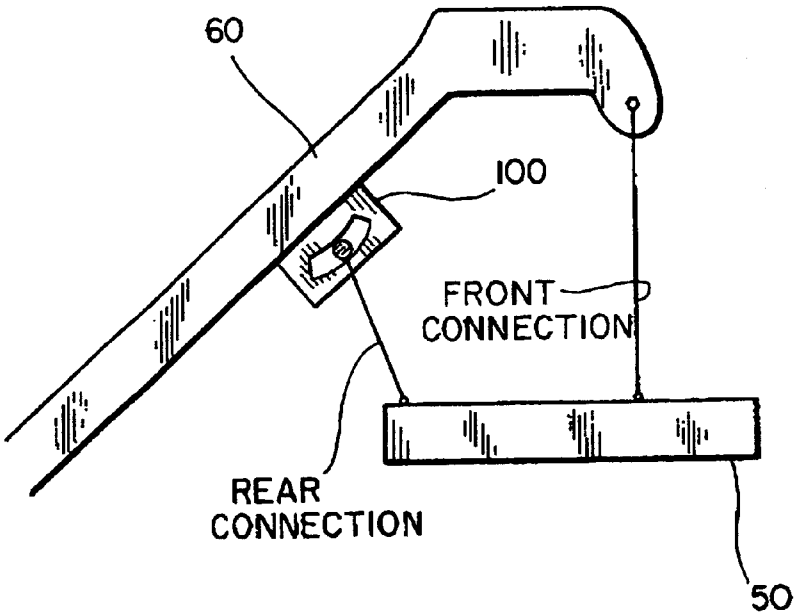
FIG. 7 is another embodiment of connector.

Yet another embodiment of the invention, FIG. 7, comprises a separate connecting structure for the rear connection point at the rear of the tong. A housing 100 having rails, grooves, or other guiding means, provides a connection to the rear chain/turnbuckle connector which still allows the tong to remain at a substantially horizontal position as the boom is raised and lowered, while providing a connection point which resists rotation of the body of the tong about an axis along a tubular being gripped by the power tong, and prevents swaying of the tong on the boom.

Use of the invention can be illustrated via a description, well known in the art, of the typical sequence of actions to make up a drill pipe connection when adding a joint of drill pipe to a drill string. The drill pipe string 101 (see FIG. 1) is suspended in the rotary of the drilling rig, with the drill pipe threaded connection commonly known as the "tool joint" at a distance of several feet above the rig floor. A joint of drill pipe is typically picked up (often by a hoist line) and lowered into the mousehole. The bottom end of the rotary kelly is then stabbed into the drill pipe connection. The present invention is then manipulated so as to place the power tong around the kelly, adjacent to the threaded connection, then the power tongs employed to screw together the connection and torque it to the desired reading, the power tongs removed from the connection thereafter. Then, the combined kelly and joint of drill pipe is picked up and stabbed into the drill string connection in the rotary. Again, the present invention is manipulated to position the power tong around the upper joint of the threaded connection, and the power tongs employed to screw the connection together to the desired torque.

In similar fashion, the invention may be used to screw together threaded connections of tubing or casing, or to make up threaded connections in the off line hole.

The invention further comprises controls for both the positioner (including extension, raising and lowering of the boom, and rotation of the upright member) and the power tongs, which may be manipulated from a control station at or near the base of the upright member or the pedestal; or from the power tongs themselves, via an umbilical which can be movably placed on or suspended near the power tongs, as shown in FIG. 1. Controls 50A are mounted on tongs 50, and permit control as described above of both the positioner (raising, lowering, and rotation) and the tong mechanism. Controls 70B are mounted on or near vertical member 75 or on pedestal 70, and controls 70B also permit operation of boom 60 and vertical member 75. Controls 70B can also be configured to control tongs 50. Yet another set of controls could be placed at or near the driller's console, with which the driller can operate both the positioner and the power tongs. In each case, the controls may be of various forms well known in the art, including hydraulic, pneumatic, electric, or operate by means of a radio signal transmitter and receiver.

While the ensuing description sets for many specificities, it is understood that same are by way of example only and not limitation. For example, different dimensions and load capacities of the boom, upright member, and pedestal could be used. The means for rotating the upright member could alternatively take the form of hydraulic cylinders. The means for raising and lowering the boom could alternatively comprise a powered ring gear. Controls for both the boom and the upright member, and the power tongs, could be of different mechanisms and mounted in different locations as convenient. In particular, the present invention contemplates the use of radio signal controls and other like means, which permit control of the apparatus from any position within radio range of the apparatus, and do not require a structural connection to the apparatus. Different means for connecting the power tongs to the boom could be employed. Further, in addition to the positioning of power tongs, the present invention can be used to position other types of equipment, and personnel, above and around the rig floor.

Therefore, the scope of the invention is to be measured not by the examples given herein, but by the scope of the appended claims and their legal equivalents.

I claim:

1. A power tong positioner, comprising:

a) a pedestal mounted on the structure of a rig, in operable relationship to the floor of said rig;

b) an upright member mounted on an upper end of said pedestal, and a bearing disposed between said pedestal and said upright member, whereby said upright member is rotatable about a substantially vertical axis;

c) a telescoping boom having first and second ends, said first end rotatably attached to said upright member by a hinge, said second end of said boom thereby movable in a vertical plane by rotation of said boom about said hinge, whereby said second end may be disposed above said rig floor so that power tongs attached to said boom may be positioned in a desired location;

d) a means for rotating said boom about said hinge and a means for rotating said upright member;

e) a means for attaching said power tongs to said boom; and f) controls for rotating said boom about said hinge and rotating said upright member, thereby positioning said power tongs in a desired position.

2. The apparatus of claim 1, wherein said means for rotating said boom about said hinge comprises a telescoping hydraulic cylinder having first and second ends, said first end fixed to said upright member and said second end fixed to said boom, whereby telescoping said hydraulic cylinder rotates said boom about said hinge; and wherein said means for rotating said upright member comprises a powered ring gear assembly.

3. The apparatus of claim 2, wherein said means for attaching said power tongs to said boom comprises a mounting plate attached to said boom, and a plurality of connecting members attaching said power tongs to said mounting plate.

4. The apparatus of claim 3, wherein said mounting plate is attached to said boom by a pin and clevis.

5. The apparatus of claim 4, further comprising a hinge between said boom and said pin and clevis, said hinge permitting rotation of said mounting plate about an axis which is substantially vertical when said boom is substantially horizontal, and a pair of hydraulic cylinders disposed between said boom and said mounting plate, for rotation of said mounting plate about said substantially vertical axis.

6. The apparatus of claim 1, wherein said controls comprise controls mounted on said power tongs.

7. The apparatus of claim 6, further comprising controls mounted proximal said upright member, for controlling rotation of said boom and said upright member.

8. The apparatus of claim 1, wherein said controls comprise radio controls.

9. Apparatus for positioning a power tong over a rig floor, comprising:

a) an upright member disposed in operable relationship to the floor of a rig, said upright member mounted atop a pedestal with a bearing disposed between said upright member and said pedestal so that said upright member is rotatable around a substantially vertical axis, a powered ring gear assembly operably connected to said upright member to effect rotation of said upright member, and wherein said pedestal is mounted on the structure of said rig;

b) a telescoping boom having a first end rotatably attached to said upright member by a hinge, and a second end which is extendable over said rig floor and is adapted to support a power tong;

c) a means for rotating said telescoping boom about said hinge; and d) controls, mounted on said power tong, for rotating said boom about said hinge and for rotating said upright member, whereby said power tong may be positioned at a desired location with respect to said rig floor.

10. The apparatus of claim 9, wherein said means for rotating said boom about said hinge comprises a telescoping hydraulic cylinder having first and second ends, said first end fixed to said upright member and said second end fixed to said boom, whereby telescoping said hydraulic cylinder rotates said boom about said hinge.

11. The apparatus of claim 10, further comprising a mounting plate attached to said boom, and a plurality of connecting members attached to said mounting plate and adapted to attach said power tongs to said mounting plate.

12. The apparatus of claim 11, wherein said mounting plate is attached to said boom by a pin and clevis.

13. An apparatus for makeup and breakout of threaded connections joining tubulars, comprising:

a) power tongs adapted to gripping tubulars and rotating threaded connections joining same, and a backup means for resisting rotation of said tubulars when said threaded connections are made;

b) a pedestal mounted on a rig structure, a bearing mounted atop said pedestal, an upright member mounted atop said bearing, and wherein said bearing comprises a powered ring gear assembly, whereby said upright member is rotatable about a substantially vertical axis;

c) a telescoping boom having a first end rotatably mounted to said upright member, whereby a second end of boom may be raised and lowered via rotation of said boom and wherein said second end of said boom is extendable to positions in operable relationship to said rig floor;

d) a power tong attached to said boom; and e) controls for controlling movement of said boom and for controlling said power tongs.

14. The apparatus of claim 13, wherein said power tong is attached to said boom by a plurality of connecting members.

15. The apparatus of claim 14, further comprising a mounting plate mounted on said boom, and wherein said plurality of connecting members connect at one end to said mounting plate and at another end to said power tong.

16. The apparatus of claim 15, further comprising a pin and clevis disposed between said mounting plate and said boom.

17. The apparatus of claim 16, further comprising a hinge between said boom and said pin and clevis, said hinge permitting rotation of said mounting plate about an axis which is substantially vertical when said boom is substantially horizontal, and a pair of hydraulic cylinders disposed between said boom and said mounting plate, for rotation of said mounting plate about said substantially vertical axis, and further comprising controls for manipulating said pair of hydraulic cylinders.

18. The apparatus of claim 17, wherein said plurality of connecting members comprises two forward connecting members and a rear connecting member; and further comprising a housing mounted on said boom, wherein said rear connecting member is disposed in a set of rails in said housing.

19. The apparatus of claim 13, wherein said controls comprise controls disposed on said power tong.

* * * * *